US006517223B2

(12) United States Patent
Hsu

(10) Patent No.: US 6,517,223 B2
(45) Date of Patent: Feb. 11, 2003

(54) LAMP RACK AND LAMP HOLDER QUICK-RELEASE CONNECTING STRUCTURE

(76) Inventor: Tien Ting Hsu, 6F, No. 292, Chang An Street, Lu Chou City, Taipei Hsien (TW)

( * ) Notice: Subject to any disclaimer, the term of this patent is extended or adjusted under 35 U.S.C. 154(b) by 43 days.

(21) Appl. No.: 09/938,724

(22) Filed: Aug. 27, 2001

(65) Prior Publication Data

US 2003/0012027 A1 Jan. 16, 2003

(51) Int. Cl.[7] ..... F21S 8/06
(52) U.S. Cl. ..... 362/405; 362/406; 362/382
(58) Field of Search ..... 362/404, 405, 362/406, 249, 147, 382

(56) References Cited

U.S. PATENT DOCUMENTS 4,748,549 A * 5/1988 Scheer ..... 362/405
5,255,173 A * 10/1993 Schonbek ..... 362/405
5,873,652 A * 2/1999 Bayer et al. ..... 362/404
6,371,632 B1 * 4/2002 Lavy ..... 206/320

* cited by examiner

*Primary Examiner*—Sandra O'Shea
*Assistant Examiner*—Hargobind S. Sawhney

(57) ABSTRACT

A lamp rack and lamp holder quick-release connecting structure includes a first connector fastened to a lamp rack by a lock nut, and a second connector fixedly provided at one end of a lamp holder for connecting the lamp holder to the first connector and for enabling electric wires to be extended from the lamp holder to the inside of the lamp rack, the first connector having a tubular mounting member with an outside annular groove, the second connector having a C-shaped retainer ring mounted in an inside annular groove thereof for engaging the outside annular groove of the mounting member to secure the second connector to the first connector.

2 Claims, 4 Drawing Sheets

LAMP RACK AND LAMP HOLDER QUICK-RELEASE CONNECTING STRUCTURE

BACKGROUND OF THE INVENTION

The present invention relates to lamps and, more particularly, to a lamp rack and lamp holder quick-release connecting structure, which enables the lamp holder to be quickly detachably fastened to the lamp rack.

There are known lamp assemblies comprised of a lamp rack and a plurality of lamp holders fastened to the periphery of the lamp rack to hold a respective lamp bulb around the lamp rack. According to conventional designs, the lamp holders are directly welded to the lamp rack. Because the lamp holders are not detachable, these lamp assemblies require much space during delivery.

SUMMARY OF THE INVENTION

The present invention has been accomplished to provide a lamp rack and lamp holder quick-release connecting structure, which eliminates the aforesaid problem. It is the main object of the present invention to provide a lamp rack and lamp holder quick-release connecting structure, which enables the lamp holder to be detachably lamp holder to be quickly, detachably fastened to the lamp rack, so that the lamp holder and the lamp rack can be detached from each other and packed separately to minimize storage space during delivery. According to one aspect of the present invention, the a lamp rack and lamp holder quick-release connecting structure comprises a first connector fastened to the lamp rack and fixedly secured thereto by a lock nut, and a second connector fixedly provided at one end of a lamp holder and adapted to connect the lamp holder to the first connector. According to another aspect of the present invention, the first connector has an outside annular groove, and the second connector has a C-shaped retainer ring mounted in an inside annular groove thereof for engaging the outside annular groove of the first connector to secure the second connector to the first connector positively after insertion of the first connector into the second connector.

DETAILED DESCRIPTION OF THE PREFERRED EMBODIMENT

Figure 1:
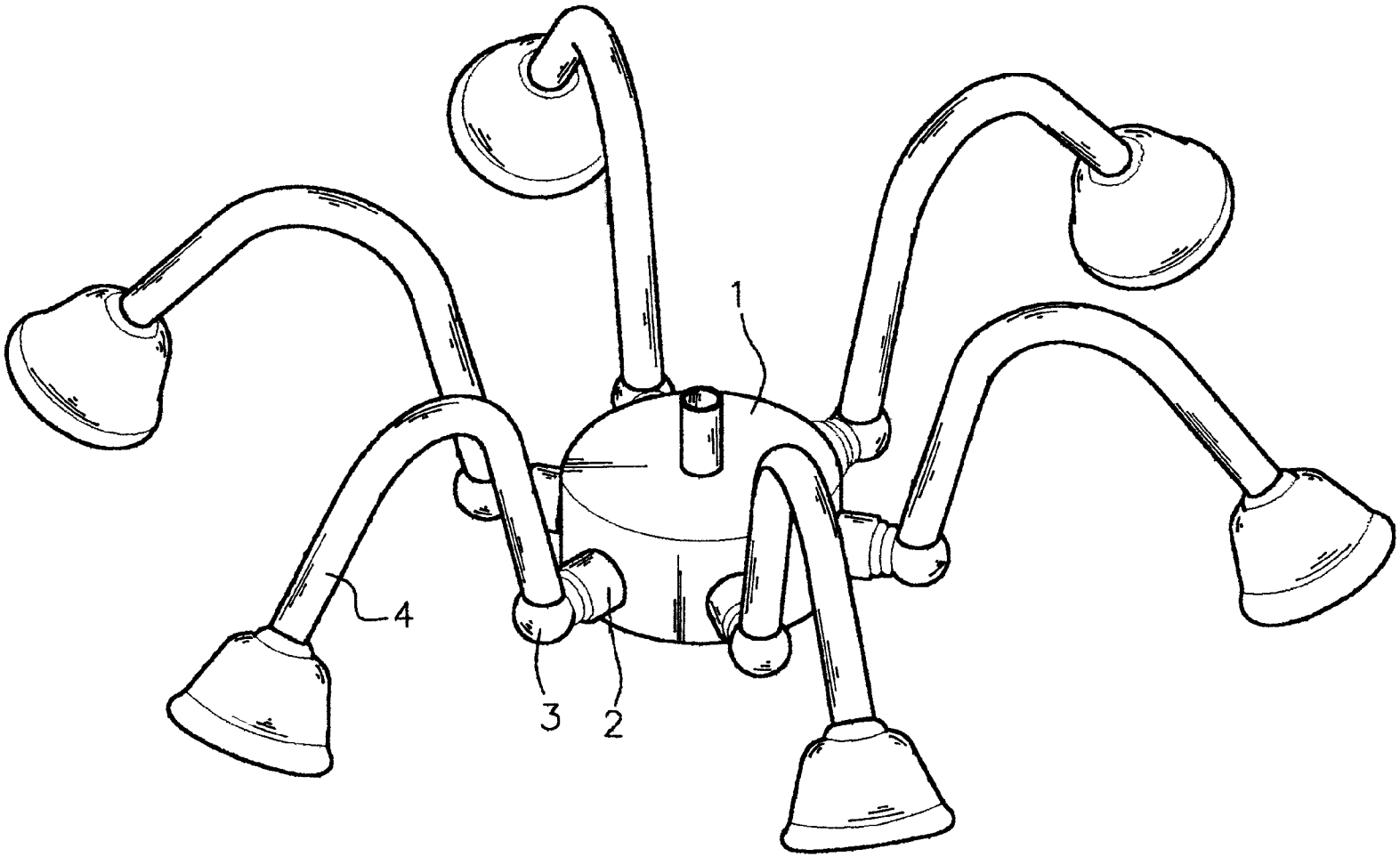
FIG. 1 an elevational view of a lamp assembly constructed according to the present invention.
Figure 2:
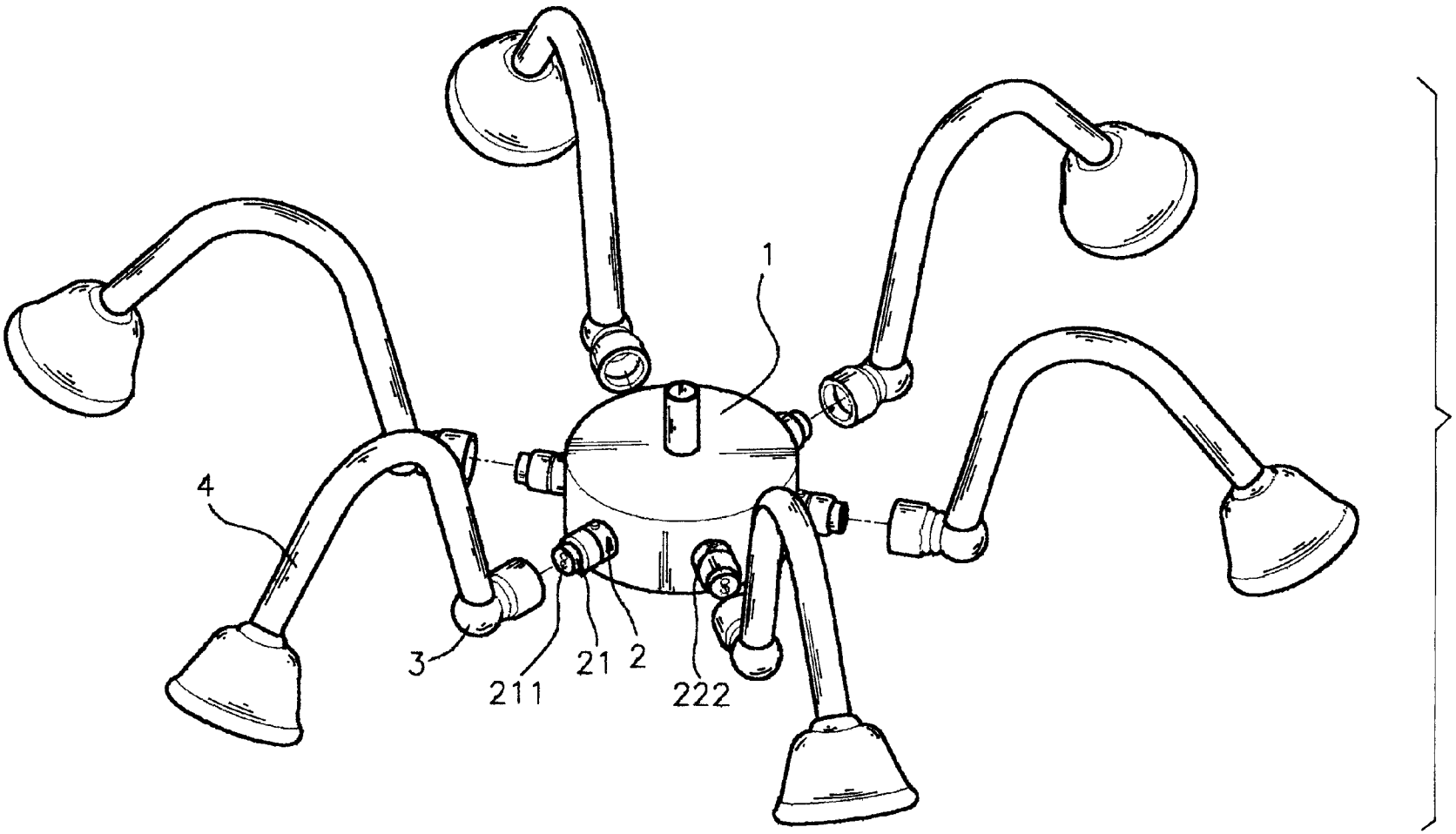
FIG. 2 is an exploded view of the lamp assembly shown in FIG. 1.
Figure 3:
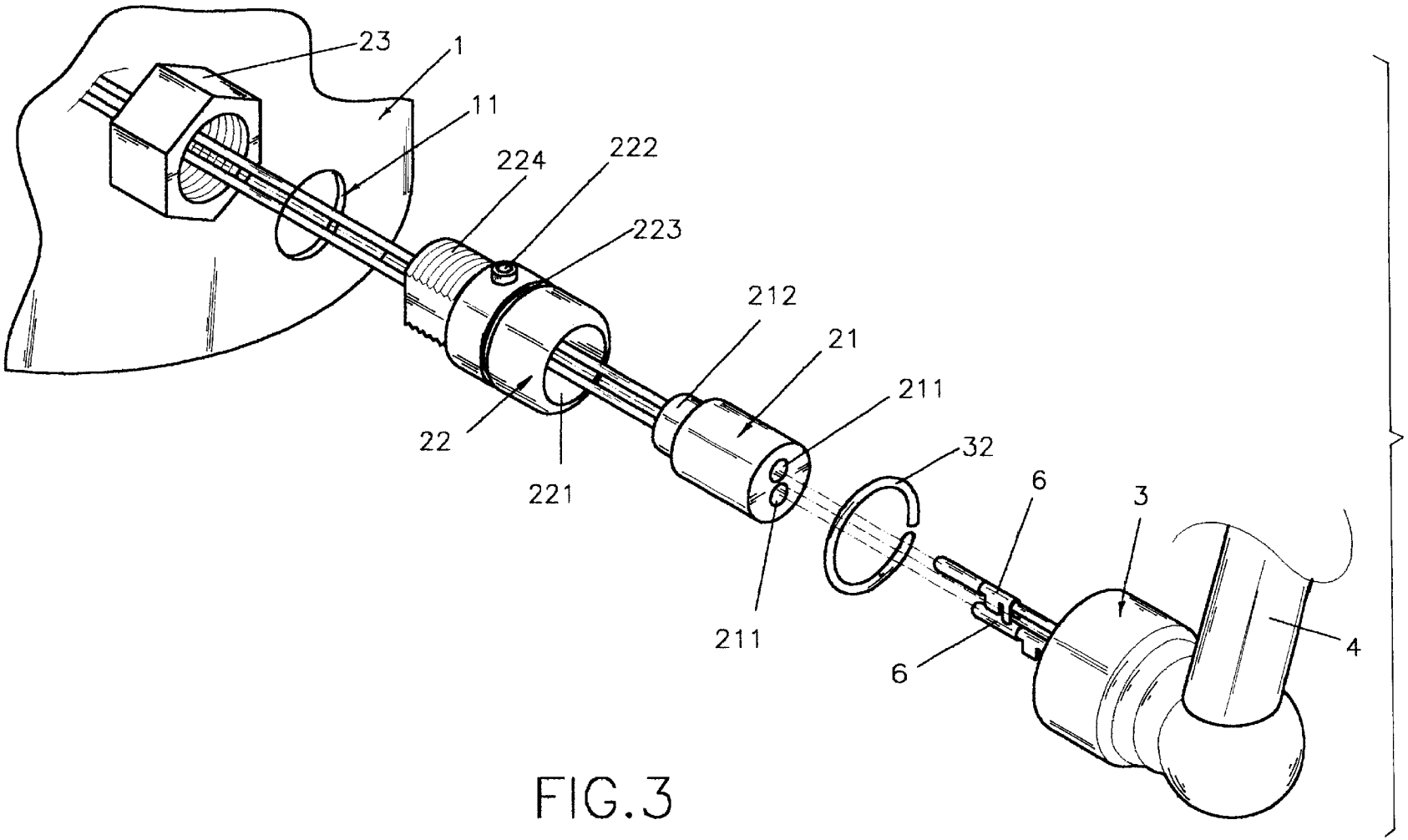
FIG. 3 is an exploded view of a lamp rack and lamp holder quick-release connecting structure according to the present invention.
Figure 4:
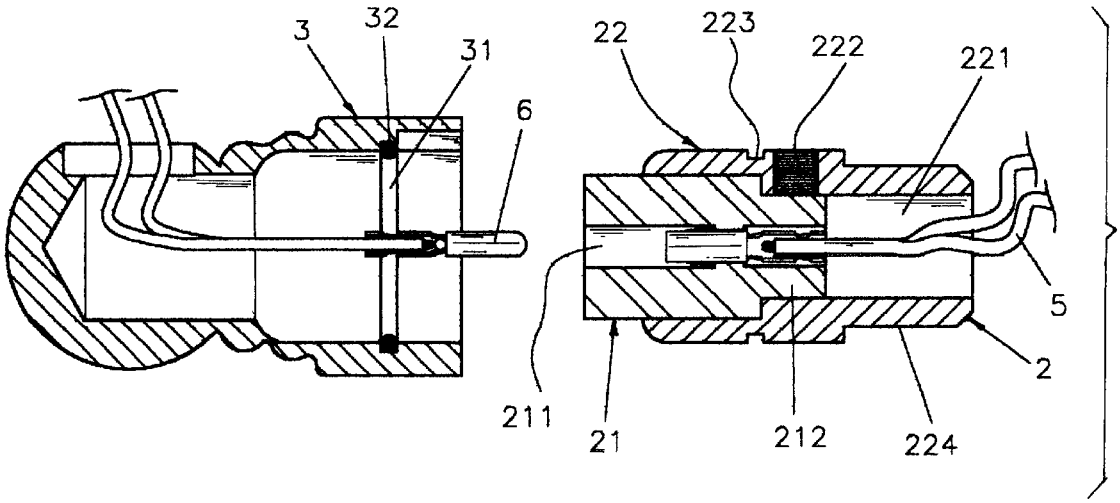
FIG. 4 is a sectional view of the present invention showing the relationship between the first connector and the second connector.

Referring to FIGS. from 1 through 5, a lamp rack and lamp holder quick-release connecting structure in accordance with the present invention comprises a first connector 2 fixedly mounted in a peripheral hole 11 of a lamp rack 1, and a second connector 3 fixedly provided at one end of a lamp holder 4 for connection to the first connector 2.

The first connector 2 comprises a coupling member 21, a mounting member 22, and a lock nut 23. The coupling member 21 has two wire holes 211 axially extended through front and rear sides thereof through which female terminal wires 5 pass respectively, a rear section of reduced diameter 212. The mounting member 22 comprises a through hole 221 axially extended through front and rear sides thereof, which receives the coupling member 21, a holding down screw 222 threaded into a radial screw hole (not shown) thereof and pressed on the periphery of the rear section of reduced diameter 212 of the coupling member 21 to secure the coupling member 21 in position, an outside annular groove 223 extended around the periphery, and a threaded rear section of reduced diameter 224. During installation, the threaded rear section of reduced diameter 224 of the mounting member 22 is inserted through the peripheral hole 11 of the lamp rack 1, and the lock nut 23 is threaded onto the threaded rear section of reduced diameter 224 to secure the mounting member 22 to the lamp rack 1.

Figure 5:
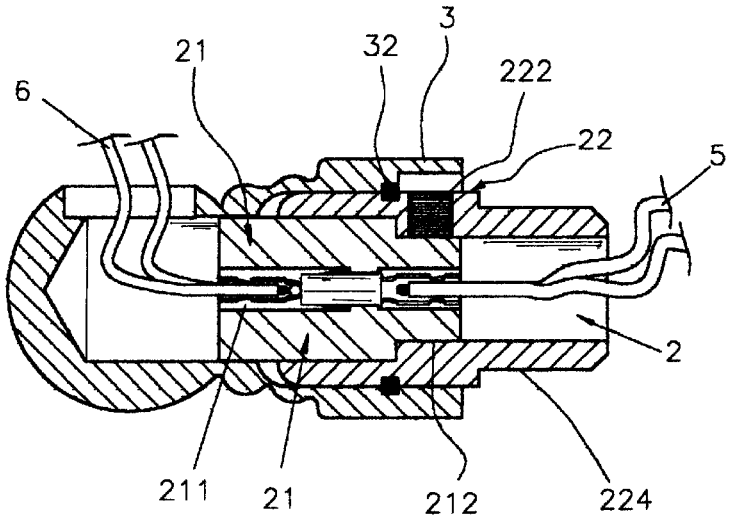
FIG. 5 is a sectional assembly view of the lamp rack and lamp holder quick-release connecting structure according to the present invention.

The second connector 3 is a hollow cylindrical member disposed in communication with the inside space of the lamp holder 4 and press-fitted onto the periphery of the mounting member 22, having an inside annular groove 32 around the inside wall thereof corresponding to the outside annular groove 223 of the mounting member 22. A C-shaped retainer ring 32 is mounted between the second connector 3 and the mounting member 22 of the first connector 2 and partially engaged into in the inside annular groove 32 of the second connector 3 and the outside annular groove 223 of the mounting member 22 to secure the second connector 3 to the first connector 2 (see FIG. 5). Further, before fastening the second connector 3 to the first connector 2, two male terminal wires 5 are respectively inserted through the mounting member 22 into the wire holes 211 and connected to the female terminal wires 6.

When pulling the lamp holder 4 outwards from the lamp rack 1 with a pulling force that surpasses the retaining force of the C-shaped retainer ring 32, the C-shaped retainer ring 32 is disengaged from the outside annular groove 223 of the mounting member 22 of the first connector 2, and thus the second connector 3 is disconnected with the lamp holder 4 from the first connector 2 at the lamp rack 1, for enabling the lamp rack I and the lamp holder 4 to be separately packed.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A lamp rack and lamp holder quick-release connecting structure installed in a lamp assembly and adapted to connect a lamp holder to a lamp rack for enabling the lamp holder to be detachably secured to the lamp rack, comprising:

a first connector fastened to the lamp rack, said first connector comprising a mounting member mounted in a through hole in the lamp rack, said mounting member comprising a through hole axially extended through front and rear sides thereof, an outside annular groove extended around the periphery thereof, and a threaded rear section of reduced diameter, a lock nut threaded onto the threaded rear section of reduced diameter to secure said mounting member to said lamp rack, a coupling member press-fitted into the through hole of said mounting member, said coupling member having a plurality of wire holes for the passing of electric wires and a rear section of reduced diameter; and a second connector fixedly mounted in one end of said lamp holder and press-fitted onto the periphery of said mounting member, said second connector being a hollow cylindrical member internally disposed in communication with the inside space of said lamp holder for the passing of electric wires to the wire holes of said coupling member of said first connector, said second connector having an inside annular groove extended around an inside wall thereof, and a C-shaped retainer ring mounted in said inside annular groove and peripherally partially engaged into the outside annular groove of said mounting member of said first connector.

2. The lamp rack and lamp holder quick-release connecting structure as claimed in claim 1 wherein said first connector further comprises a holding down screw radially threaded through said mounting member and pressed on the rear section of reduced diameter of said coupling member to secure said coupling member to said mounting member.

* * * * *